United States Patent [19]

Trauschke

[11] Patent Number: 4,895,296

[45] Date of Patent: Jan. 23, 1990

[54] SLEEVE CARTON WITH FLARING LIPS

[75] Inventor: William F. Trauschke, Topsfield, Mass.

[73] Assignee: GTE Products Corporation, Danvers, Mass.

[21] Appl. No.: 255,235

[22] Filed: Oct. 11, 1988

[51] Int. Cl.[4] ..... B65D 5/06

[52] U.S. Cl. ..... 229/40; 206/427; 229/115; 229/138

[58] Field of Search ..... 229/40, 115, 137, 138; 206/44.11, 427, 429, 434

[56] References Cited

U.S. PATENT DOCUMENTS

| | | | |
|---|---|---|---|
| Re. 24,925 | 1/1961 | Fisher | 206/427 |
| 695,557 | 3/1902 | Houghland | 229/115 |
| 1,221,785 | 4/1917 | Williams | 229/115 |
| 2,849,112 | 8/1958 | Forrer | 229/40 |
| 3,005,546 | 10/1961 | Sanford | 229/40 |
| 3,167,214 | 1/1965 | Mahon | 229/40 |
| 4,570,796 | 2/1986 | Groom | 229/40 |
| 4,582,198 | 4/1986 | Ditton | 229/138 |

FOREIGN PATENT DOCUMENTS

| | | | |
|---|---|---|---|
| 1438561 | 4/1966 | France | 229/40 |
| 736218 | 9/1955 | United Kingdom | 206/427 |
| 1040748 | 9/1966 | United Kingdom | 229/40 |

*Primary Examiner*—Gary Elkins

*Attorney, Agent, or Firm*—William E. Meyer

[57] ABSTRACT

A sleeve carton having flare lip panels is disclosed. A sleeve carton may be formed with flaring lip panels on the inner edge of the sleeve entrance. The lip panels bulge into the entrance, but are easily compressed. The inner edge of the lip panels catches on flat packaged items being withdrawn from the sleeve. The flaring lip panels then act as a latch for inserted flat or similar flat packages loaded in the sleeve.

16 Claims, 4 Drawing Sheets

SLEEVE CARTON WITH FLARING LIPS

TECHNICAL FIELD

The invention relates to packaging and particularly to folded boxes. More particularly the invention is concerned with an improved sleeve type carton.

BACKGROUND ART

A sleeve carton typically comprises a rectangular tube with four sides, open at one end and sometimes at both ends. A sleeve carton may serve as a shipping, display or dispensing unit for other packages, such as blister packs. Flat display packages commonly called blister packs are used to hold a conveniently small number of items, such as small light bulbs, on a flat card. The card may include a hole so a group of the flat packages may be strung on a horizontal rod for display and then selection by a consumer. Alternatively, the flat packages may be stored on a shelf in a surrounding sleeve carton to keep the flat packages from disordering. The sleeve carton filled with flat packages may also be sold as a unit.

The sleeve carton holding flat packages poses a number of problems. The flat packages must be loaded in the sleeve carton, and securely retained during shipping and display. The blister side of a blister pack is frequently irregular, so loading the sleeve carton by hand is often preferred. One method of forming the sleeve carton would be to stack a series of flat packages and wrap a cover around the stack leaving two ends open for access. Unfortunately, for soft flat packages, a wrapped sleeve carton is difficult to form since the retained flat packages may be crushed. The soft flat packages also tend to fall from the open ends. An alternative, is to form a solid sleeve carton and insert the flat packages. The inserted flat packages may be dislodged where only friction holds the flat packages in the sleeve carton. A further alternative is to partially enclose the sleeve carton with a sealed flap or other standard closure. The inserted flat packages may subsequently be exposed by removing the sealed flap to open the sleeve carton. Enclosing requires additional expense, and subsequent opening invites tearing of the sleeve carton. Hand loading is likely to be frustrated by the flaps, covers, or other known features needed for retaining loosely included packages. There is then a need to provide a sleeve carton that securely holds the enclosed flat packages, and is easily loaded by hand or machine.

Similarly, the retained flat packages must also be easily removed by a customer, without having to damage the sleeve carton, or letting the remaining flat packages spill out. For simple wrapped sleeve carton, the first flat package is likely to be difficult to remove, but remaining flat packages may fall out freely since the compression induced friction holding the flat packages has been reduced. Sleeve cartons that require opening need attention by clerks to see that each sleeve carton is opened correctly, and not misopened by unconcerned consumers. There is then a need to provide a durable sleeve carton that is easily accessed by a user.

DISCLOSURE OF THE INVENTION

A sleeve carton may be formed as a hollow sleeve with at least three parallel rectangular sleeve panels, each panel having two parallel and opposite seam edges and at least one opening edge intermediate the seam edges. Each sleeve panel is coupled along the opposite seam edges to two respective adjacent sleeve panels. The sleeve panels have opening edges adjacent and coplanar thereby defining a sleeve with an enclosed volume. At least one flare panel is positioned in the enclosed volume, adjacent a sleeve panel, and coupled along an opening edge to the opening edge of the adjacent sleeve panel. The flare panel projects into the enclosed cavity and away from the adjacent sleeve panel allowing easy insertion, and removal of packages, but supplies control to limit loose discharge of contained packages.

BEST MODE FOR CARRYING OUT THE INVENTION

Figure 1:
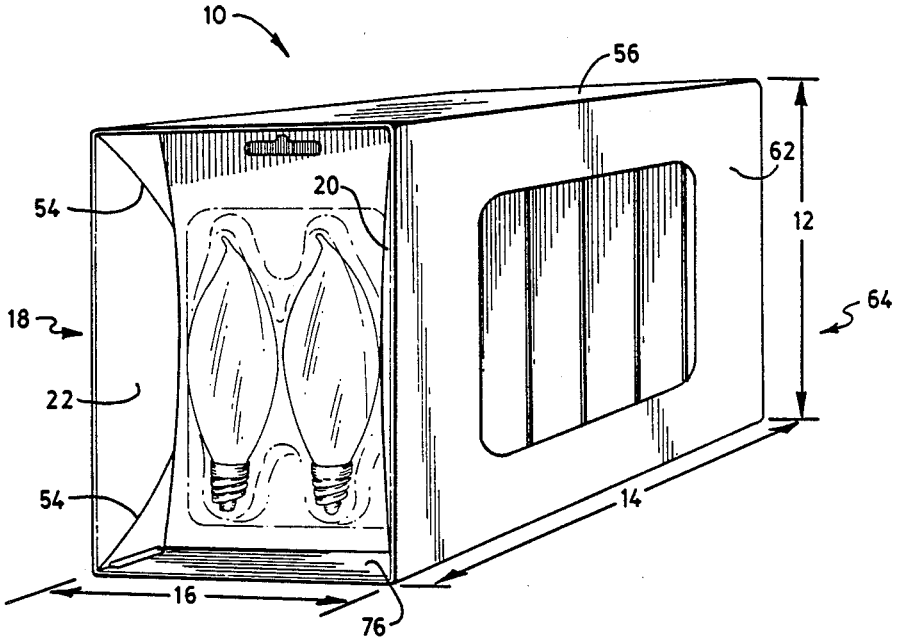
FIG. 1 shows front perspective view of a preferred embodiment of a sleeve carton with flaring lips.

FIG. 1 shows a preferred embodiment of a sleeve carton 10. The sleeve carton 10 has the overall form of a right rectangular parallelepiped having a height 12, width 14 and depth 16. The sleeve carton 10 also has at least one open end 18, and preferably two opposite open ends. A window may be formed in a front panel or a back panel providing a view of the sleeve carton 10 contents. The open end or ends allow ready access to the displayed contents. Formed in the entrance of the open end 18 or ends, a flaring right lip 20 and flaring left lip 22 allow flat packages to be easily loaded into the sleeve carton 10, by hand or machine, and securely retained during shipping and display. The lip panels 20, 22 are readily compressed to release the enclosed flat package. A consumer may then easily access the displayed flat packages by slipping the enclosed flat package over the lip edges.

Figure 2:
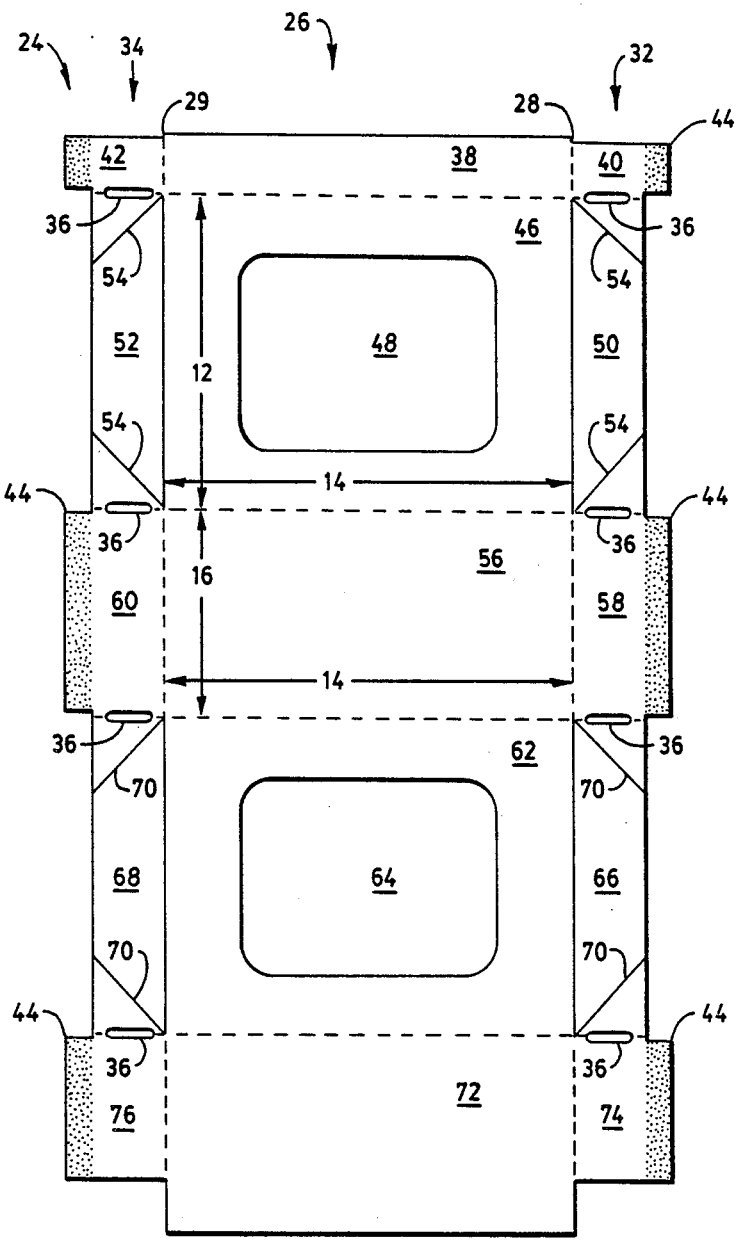
FIG. 2 shows a preferred blank for the sleeve carton of FIG. 1.

FIG. 2 shows a preferred flat blank 24 for the sleeve carton 10 of FIG. 1. The blank 24 comprises a flat cardboard, or similar thin flexible material, cut in outline, perforated and scored along fold lines to form separate hinged panels. The outlined blank 24 encompasses all of the panels and included elements of the sleeve carton 10, and may be folded and glued to form the sleeve carton 10 shown in FIG. 1. Perforations designed to promote folds that break sharply are shown as dashed lines, while score lines for more resilient folds are shown as solid lines internal to the perimeter of the blank 24. The fold lines of blank 24 generally follow a rectangular pattern allowing square hinging of the panels.

In the preferred embodiment, the blank 24 comprises a main row 26 of rectangular panels, side by side, adjacent and parallel to each other. Adjacent panels along the main row 26 may be hinged along main panel folds that are materially continuous, but are preferably joined along perforated scores allowing sharper folds to be made. The main row panels 26 are positioned between two parallel main fold lines, a right side fold line 28, and a left side fold line 30, separated by the carton width 14.

Flanking the main row panels 26 are a row of right side lip panels 32 and a row of left side lip panels 34. In the preferred embodiment, for each main row panel 26 there is then an adjacent right side lip panel and an adjacent left side lip panel. The main panel folds continue across the main fold lines 28, 30 as hinge separations between the respective adjacent rows 32, 34 of lip panels. In the particular embodiment, the lip panels comprise alternating flush and flare panels. The flush panels are designed to lie flat against an adjacent main row panel 26, and may include a glue receiving area, or other means for securing the flush panel to an adjacent panel. The flare panels are designed to buckle under compression, and flare away from an adjacent main row panel 26. If only one end of the carton 10 is to be opened, then one of the lip panel rows 32, 34 may be replaced by a flap closure system or other carton closure as known in the art.

In the preferred embodiment, adjacent lip panels are partially separated by elongated stress relief holes 36 positioned parallel with the scores separating adjacent lip panels, and centrally between the blank perimeter, and the respective main fold line. Scored sections extend on either side of the stress relief holes 36 to the blank perimeter, and to the respective main fold line to provide a secure, foldable linkage between the adjacent lip panels.

In the preferred embodiment, the first panel of the main row 26 is a seal tab 38. The seal tab 38 has the carton width 14 and less than the carton depth 16. Hinged at right angles at either side of the seal tab 38, and across perforated sections of the main fold lines 28, 30 are a right seal tab flush panel 40 and a left seal tab flush panel 42 with glue receiving extensions 44.

Next along the main row 26, hinged in series with the seal tab 38 is a back panel 46 with the carton height 12 and carton width 14. Formed within the perimeter of the back panel 46, may be a back window 48. Hinged at right angles at either side of the back panel 46, and across scored sections of the main fold lines are a right back flare panel 50 and a left back flare panel 52. The back flare panels have the carton height 12 and preferably no more than half the carton width 14. The back flare panels 50, 52 include score lines 54 angled from the intersection of the main panel folds and the main fold lines 28, 30; extend across the back flare panels 50, 52 to the blank 24 perimeter.

Next along the main row 26, hinged in series with the back panel 46 is a top panel 56 with the carton depth 16 and carton width 14. Hinged at either side of the top panel 56 across perforated sections of the main fold lines are a right top flush panel 58 and a left top flush panel 60 having the carton depth 16 and no more than half the carton width 14. The right and left top flush panels 58, 60 may have glue receiving extensions 44.

Next along the main row 26, hinged in series with the top panel 56 is a front panel 62 with the carton height 12 and carton width 14. Formed centrally in the front panel 62 may be a front window 64. Hinged at right angles at either side of the front panel 62, are a right front flare panel 66 and a left front flare panel 68. The front flare panels 66, 68 have the carton height 12 and no more than the carton width 14. The front flare panels 66, 68 include score lines 70 angled from the intersection of the main panel folds and the main fold lines 28, 30; extend across the top flush panels 58, 60 to the blank 24 perimeter.

Next along the main row 26, hinged in series with the front panel 62 is a bottom panel 72 with the carton depth 16 and carton width 14. Hinged at either side of the bottom panel 72 across perforated sections of the main fold lines 28, 30 are a right bottom flush panel 74 and a left bottom flush panel 76 having less than the carton depth 16 when added to the bottom seal depth 16 dimension, and no more than the carton width 14. The right and left bottom flush panels 74, 76 may have glue receiving extensions 44.

The preferred embodiment of the sleeve carton 10 may be assembled by first applying a glue to the glue extensions 44 of the flush panels. The row of right side lip panels 32 may be hinged 180° over the respective adjacent main row panels 26 along the right side main fold line 28. Next, the row of left side lip panels 34 may be hinged 180° over the respective adjacent main row panels 26 along the left side main fold line 30 to be on the same side as the row of right lip panels 32. If the flush panels are to be sealed to the adjacent main row panels 26, the adjacent pairs may now be pressed together to assure secure sealing. The front panel and back panel make smooth continuous hinged connections with the folded over adjacent flare panels thereby providing a rounded hinge back edge facing outwards.

The sleeve is then hinged together so the lip panel rows are on the inside of the sleeve. The seal tab 38 is hinged 90° to the back panel 46 in the direction of the lip panel rows 32, 34 to make a main panel seam. The back panel 46 is in turn hinged 90° to the top panel 56, and the top panel 56 is in turn hinged 90° to the front panel 62 to make two more main panel seams. The front panel 62 is in turn hinged 90° to the bottom panel 72 to make a fourth main panel seam. The seal tab 38 is now parallel and adjacent the bottom panel 72. The seal tab 38 and bottom panel 72 are coupled, by for example gluing, to form a solid linkage between the two. The folded blank 24 now has the form of a rectangular parallelepiped with two open ends defining an enclosed cavity with an axis parallel to the panels, and the main panel seams between the folded panels. In other words, the blank 24 may be folded into a rectangular sleeve carton 10 open at two ends.

The flush and flare panels of the lip panels alternate on the inside of the sleeve entrances adjacent the inner surface of the sleeve carton 10 attached along the edges of the open ends. The main row panels 26 are large, and strongly linked, and where perforations are used, have sharp fold lines. The main row panels 26 are linked by the seal tab 38 and bottom panel 72. The lip panel rows 32, 34 follow a shorter path along the inside entrance of the sleeve. The lip panel rows are then under compression, and forced to buckle. The flare panels 50, 52, 66, 68, not being glued and having included score lines 54, 70 buckle more easily, and therefore preferentially flare into the sleeve cavity defined by the folded main row panels 26. The flare panels 50, 52, 66, 68 then define lips at the inner edges of the open ends of the sleeve carton 10. Since the flare panels 50, 52, 66, 68 are made of a flexible material, the flaring lip panels may still be compressed to the sleeve walls. The stress relief holes 36 release pressure placed on the corners, and adjacent folds, thereby helping to limit possible bursting of the main panel seams adjacent the sleeve entrance.

The assembled sleeve carton 10 has two open ends. A flat package, such as a flat card holding two small lamp bulbs in a blister pack, may be inserted through one of the openings by compressing a set of flare panels, for example 50, 66, to be positioned in the sleeve cavity. The flat packages are exposed through the front window 64. The opposite sides of the flat packages are similarly exposed through the back window 48. The flat packages are restrained from falling out by friction with the sleeve, and the obstructing edges of the flare panels 50, 52, 66, 68.

Figure 3:
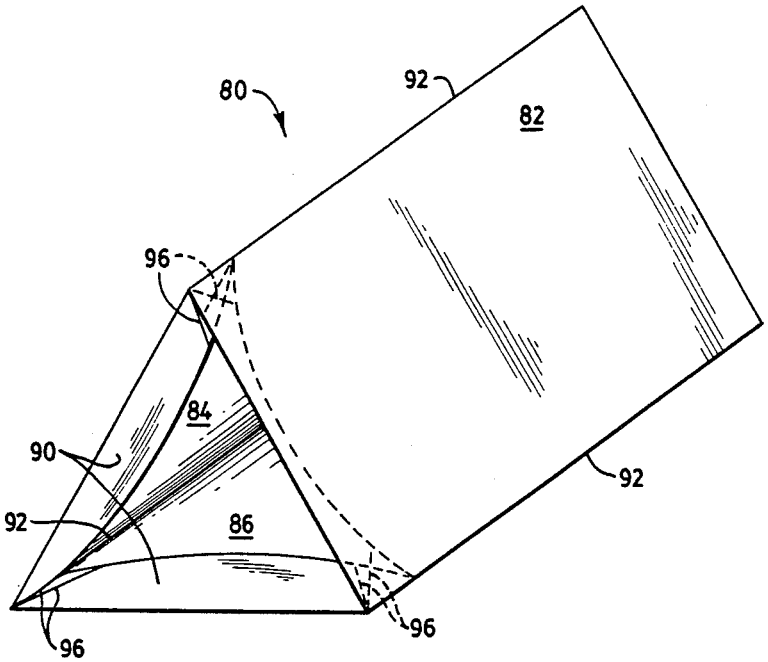
FIG. 3 shows an alternative three sided sleeve with flaring lips.
Figure 4:
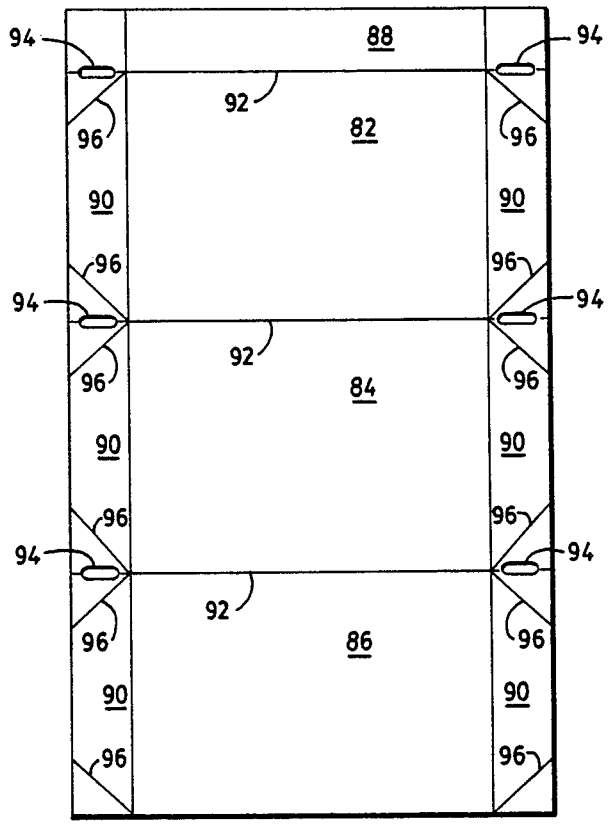
FIG. 4, shows a blank for forming the three sided sleeve of FIG. 3.

FIG. 3 shows an alternative three sided sleeve 80 with three flaring lips. No windows are included in the three sided sleeve, and all three lip panels adjacent the sleeve entrance flare into the sleeve cavity. FIG. 4 shows a blank for making the three sided sleeve. Three main panels 82, 84, 86 are hinged in a row with a seal tab 88 so that a three sided tube may be folded. Hinged on either side of the main panels 82, 84, 86, 88 are six adjacent flare panels 90 that may be folded over the main panels to be captured on the inside of the three sided tube after construction. The flare panels 90 are separated by extensions of the main panel scores 92, and include stress relief cut outs 94. Angled scores 96 are included in the six flare panels 90 to encourage flaring into the sleeve cavity on construction of the sleeve. No flush panels are included in the three sided sleeve.

Although the preferred embodiment is a four sided sleeve with open ends and two flare panels in each end, other variations may be made. In particular, a sleeve of any number of three or more rectangular, and parallel panels may be positioned in a row to form a sleeve. An adjacent row of lip panels may be positioned along a main fold line, with each lip panel associated with a sleeve panel. All of the lip panels may be flaring panels, or some may be flush panels, or some may be removed provided the ends of the flare panels receive a compressive force by some means. The compressive force in the preferred embodiment is generated by making the sleeve and adjacent flare panels the same length, and then folding the sleeve to constrain the flare panel in a shorter space, thereby forcing the flare panel to buckle.

It is convenient to make a sleeve with an even number of sleeve panels, with alternating flare and flush panels. The alternate flush panels may include extensions for receiving glue, for example applied by a roller, or timed applicator. The glued flush panels then securely anchoring the ends of the adjacent flare panels. The alternating flare panels are then diametrically opposite to symmetrically capture the carton contents. The flush and flare panels may alternate, or all or the panels may be flare panels, or only some of the panels need to be flare panels. The flare panels may be formed, and attached by other means. It is esthetic that a flaring panel have a folded hinge connection with the adjacent main row panel, thereby forming a rounded hinge back edge facing outwards. It is convenient to attach the ends of the flare panels to flush panels, but mechanically it is only important that the ends of the flush panels be constrained to receive a compression force to causing the flare panels to buckle. The compressive force is best received at points offset from the hinge with the sleeve panel. The score lines across the flare panel are best at an angle to both the perimeter of the blank, and the hinge with the sleeve panel. The flush panels may be segmented or otherwise cut provided the ends adjacent the flare panels are anchored to transmit a compressive force to the flare panels. Although the preferred utility of the sleeve is with respect to flat packages, other contained elements are anticipated, and nothing here is intended to restrict the application of the sleeve to particular carton contents.

In a working example some of the dimensions were approximately as follows: The front panel was 15 cm wide and 20 cm wide. The sleeve carton 10 was 10 cm deep. The flare panels were 3.5 cm wide and 15 cm high, with 45° folding scores running from the intersection of the main fold line and the perforation lines separating the main panels. The seal tab was 2.9 cm high and 15 cm wide. The bottom panel was 9.5 cm high and 15 cm wide. The front panel was 14 cm by 14 cm with a 10.8 cm rectangular window. The back was 15 cm by 20 cm with a 12.4 cm by 9.3 cm window.

The disclosed dimensions, configurations and embodiments are as examples only, and other suitable configurations and relations may be used to implement the invention. It is a well known in the folded box art that panels may be moved from one attachment point to another, thereby yielding a different blank, but still producing the same box when the blank is folded. At tab, or tongue may be required to provide sufficient strength to the new linkages. Variations in the blank pattern are anticipated, and all such blank variations when folded that produce the sleeve carton described are considered equivalent to the described structure. The disclosed operating conditions, dimensions, configurations and embodiments are as examples only, and other suitable configurations and relations may be used to implement the invention. While there have been shown and described what are at present considered to be the preferred embodiments of the invention, it will be apparent to those skilled in the art that various changes and modifications can be made herein without departing from the scope of the invention defined by the appended claims.

What is claimed is:

1. A sleeve carton comprising:

(a) a hollow sleeve with at least three rectangular sleeve panels, each sleeve panel having two parallel and opposite seam edges and at least one opening edge intermediate the respective seam edges, each sleeve panel coupled along the respective seam edges to two respective adjacent sleeve panels thereby forming sleeve seams between the adjacent sleeve panels with the respective opening edges adjacent and coplanar thereby defining a sleeve with an enclosed cavity having an axis parallel to the sleeve panels, and parallel to the sleeve seams, and at least one open end defined by the coplanar opening edges one each from the respective sleeve panels, and (b) at least one lip panel positioned in the enclosed cavity, hinged on a first lip panel edge to a first of the respective sleeve panels along the opening edge of the respective first sleeve panel, having a second edge of the flaring lip panel transverse to the first lip panel edge, and contacting a respective first sleeve seam formed between the first sleeve panel and an adjacent second of the respective sleeve panels, and a third edge of the flaring lip panel opposite the second edge of the flaring lip panel transverse to the first lip panel edge, and contacting a respective second seam formed between the first sleeve panel and an adjacent third of the respective sleeve panels, to receive a compressive force from the second sleeve panel and third sleeve panel, the lip panel thereby flaring into the enclosed cavity and away from the adjacent respective first sleeve panel.

2. A carton blank for a flaring lip sleeve carton comprising: a flat foldable material separated into rectangular panels including (a) a first row of at least three adjacent sleeve panels separated by parallel seam edges, each sleeve panel having at least one opening edge on a similar end of the respective sleeve panel, and intermediate the seam edges of the respective sleeve panel, the opening edges being colinear to define a common main fold line perpendicular to the seam edges.

(b) means for coupling a first end of the row of sleeve panels to an opposite second end of the row of sleeve panels to form a sleeve, (c) at least one flaring lip panel, hinged along a first flaring lip panel edge to the opening edge of a respective first of the sleeve panels, having a second edge transverse to the opening edge of the respective first sleeve panel, and a third edge transverse to the opening edge of the respective first sleeve panel and opposite the second flaring lip panel edge, (d) a first compressive force transmitting means coupled to the second flaring lip panel edge for transmitting a compressive force to the flaring lip panel in the direction of the third flaring lip panel edge to cause the flaring lip panel to arc, and (e) a second compressive force transmitting means coupled to the third flaring lip panel edge for transmitting a compressive force in the direction of the second flaring lip panel edge to cause the flaring lip panel to arc.

3. The carton blank in claim 2, wherein the carton blank includes an even number of sleeve panels.

4. The carton blank in claim 3, wherein the carton blank includes four sleeve panels.

5. The carton blank in claim 2, wherein the means for coupling comprises a seal tab coupled to a respective first sleeve panel along the row of sleeve panels, and along an edge parallel with the sleeve panel seam edges.

6. The carton blank in claim 2, wherein the flaring lip panel includes score lines to enhance buckling of the flaring lip panel.

7. The carbon blank in claim 2, wherein the first compressive force transmitting means includes a panel having a first edge coupled along a portion of the second flaring lip panel edge, and a second edge coupled to the second of the respective sleeve panels.

8. The carton blank in claim 7, wherein the second force transmitting means includes a panel having a first edge coupled along a portion of the third flaring lip panel edge, and a second edge coupled to the third of the respective sleeve panels.

9. The carbon blank in claim 2, wherein the second edge of the flaring lip panel contacts the respective first seam between the first panel and the second panel, and the third edge of the flaring lip panel opposite the second edge of the flaring lip panel contacts the second seam between the first panel and the third panel adjacent the first panel, to receive a compressive force from the second panel and the third panel.

10. The carton blank in claim 2, wherein the length of the flaring lip panel from the first edge connection to the second edge connection is larger than the length of the second panel from the first edge connection to the second edge connection.

11. The carton blank in claim 3, wherein the seam edges between the sleeve panels are perforated.

12. The carton blank in claim 2, wherein the flaring lip panel includes fold scores at an angle to the main fold line, and extending across the lip panel to an edge opposite the main fold line.

13. A carton blank for a sleeve carton with flaring lips comprising: a flat foldable material separated into rectangular panels including a row of at least three adjacent sleeve panels separated by parallel seam folds, each sleeve panel having a respective same end defined by a common main fold line perpendicular to the seam folds, (b) means for coupling a respective first end of the row of sleeve panels to an opposite second end of the row of sleeve panels to form a sleeve, (c) a row of generally rectangular lip panels adjacent and respectively coupled to the row of sleeve panels along the main fold line, and separated respectively by colinear extensions of the parallel seam folds, and further including a self closed edge positioned across at least one of the fold lines extending between adjacent lip panels, offset from the main fold line, and offset from the perimeter of the carbon blank to define and encompass a cut out portion of the carton blank.

14. The carton blank in claim 13, wherein at least one of the lip panels includes an extension for receiving glue.

15. The carton blank in claim 13, wherein alternate lip panels include extensions for receiving glue.

16. The carton blank in claim 13, wherein a window is included within the perimeter of one of the sleeve panels.

* * * * *